US011145168B2

(12) United States Patent
Filipour, Jr. et al.

(10) Patent No.: US 11,145,168 B2
(45) Date of Patent: Oct. 12, 2021

(54) SKILL GAME SIDE WAGERING WITH PLAYER INCENTIVES

(71) Applicant: IGT, Las Vegas, NV (US)

(72) Inventors: Cameron Filipour, Jr., Las Vegas, NV (US); Bryan Upton, Hertfordshire (GB); Cyrus Luciano, Reno, NV (US); Alexander White, Reno, NV (US)

(73) Assignee: IGT, Las Vegas, NV (US)

( * ) Notice: Subject to any disclaimer, the term of this patent is extended or adjusted under 35 U.S.C. 154(b) by 72 days.

(21) Appl. No.: 15/709,690

(22) Filed: Sep. 20, 2017

(65) Prior Publication Data

US 2018/0089961 A1 Mar. 29, 2018

Related U.S. Application Data

(60) Provisional application No. 62/398,863, filed on Sep. 23, 2016.

(51) Int. Cl.
*G07F 17/32* (2006.01)

(52) U.S. Cl.
CPC ..... *G07F 17/3295* (2013.01); *G07F 17/3209* (2013.01); *G07F 17/3211* (2013.01); *G07F 17/3225* (2013.01); *G07F 17/3246* (2013.01); *G07F 17/3248* (2013.01); *G07F 17/3274* (2013.01)

(58) Field of Classification Search
CPC ..... G07F 17/3295; G07F 17/3209; G07F 17/3211; G07F 17/3225; G07F 17/3246; G07F 17/3248; G07F 17/3274
See application file for complete search history.

(56) References Cited

U.S. PATENT DOCUMENTS 5,539,510 A * 7/1996 Yamashiro ..... G03G 15/6561 399/137
5,593,349 A * 1/1997 Miguel ..... F41J 3/00 273/371
5,653,444 A * 8/1997 Dahl ..... A63F 3/00157 273/274
5,707,285 A * 1/1998 Place ..... A63F 3/00157 273/292
5,711,715 A * 1/1998 Ringo ..... G07F 17/32 273/293

(Continued)

*Primary Examiner* — Ronald Laneau
*Assistant Examiner* — Matthew D Hoel
(74) *Attorney, Agent, or Firm* — Sage Patent Group

(57) ABSTRACT

A gaming system offers players the opportunity to play a skill-based challenge and bettors to place wagers based on events or outcomes in the skill-based challenge. A gaming system includes a processor, a display device, an input device and a memory device storing a plurality of instructions which, when executed by the processor, cause the processor to operate with the display device and the input device, for a play of a wagering game, to perform operations. Operations include receiving, from a bettor, a wager that corresponds to a selected player of a plurality of players in a skill-based challenge, determining that the selected player has achieved a threshold outcome in the skill-based challenge, awarding a bettor monetary prize to the bettor in response to the selected player achieving the threshold outcome in the skill-based game, and awarding a player monetary prize to the selected player.

20 Claims, 9 Drawing Sheets

(56) References Cited

U.S. PATENT DOCUMENTS 5,779,594 A * 7/1998 Minowa ..... B60W 10/06 477/109
5,816,918 A * 10/1998 Kelly ..... A63F 3/081 463/16
5,984,779 A * 11/1999 Bridgeman ..... G07F 17/323 273/138.2
6,113,102 A * 9/2000 Marks ..... A63F 3/00157 273/292
6,142,872 A * 11/2000 Walker ..... G07F 17/32 340/323 R
6,174,237 B1 * 1/2001 Stephenson ..... A63F 13/12 463/42
6,206,782 B1 * 3/2001 Walker ..... G07F 17/32 463/20
6,523,831 B2 * 2/2003 Webb ..... A63F 3/00157 273/292
10,587,905 B2 * 3/2020 Ortiz ..... A63F 13/355
10,673,924 B2 * 6/2020 Boudville ..... A63F 13/65
2001/0019965 A1 * 9/2001 Ochi ..... G07F 17/3288 463/25
2002/0004424 A1 * 1/2002 Nelson ..... G07F 17/32 463/42
2002/0049082 A1 * 4/2002 Bansemer ..... A63F 9/0291 463/20
2003/0003989 A1 * 1/2003 Johnson ..... G07F 17/32 463/25
2003/0220143 A1 * 11/2003 Shteyn ..... A63F 13/792 463/42
2004/0080110 A1 * 4/2004 Webb ..... A63F 3/00157 273/292
2006/0188855 A1 * 8/2006 Okada ..... G07F 17/32 434/227
2006/0232012 A1 * 10/2006 Boyer ..... A63F 1/00 273/292
2007/0288316 A1 * 12/2007 Burns ..... G07F 17/3255 705/14.14
2008/0113733 A1 * 5/2008 Kushner ..... G06Q 50/34 463/17
2008/0153569 A1 * 6/2008 Tanabe ..... G07F 17/3211 463/20
2008/0297997 A1 * 12/2008 Anderson ..... A63J 99/00 361/679.02
2009/0191953 A1 * 7/2009 Moreno ..... G07F 17/32 463/25
2009/0191969 A1 * 7/2009 Moreno ..... G07F 17/3276 463/40
2014/0364981 A1 * 12/2014 Hofstetter ..... G06Q 10/10 700/92
2015/0375101 A1 * 12/2015 George ..... A63F 13/35 463/24
2015/0375102 A1 * 12/2015 George ..... A63F 13/20 463/24
2015/0375103 A1 * 12/2015 George ..... A63F 13/86 463/24
2016/0055711 A1 * 2/2016 Arnone ..... G07F 17/32 463/9
2016/0166935 A1 * 6/2016 Condrey ..... A63F 13/48 463/31
2016/0196722 A1 7/2016 David et al.
2018/0124148 A1 * 5/2018 Boudville ..... A63F 13/5378
2018/0167656 A1 * 6/2018 Ortiz ..... A63F 13/355
2019/0244483 A1 * 8/2019 Collins ..... A63F 13/352
2020/0228855 A1 * 7/2020 Ortiz ..... A63F 13/46

* cited by examiner

SKILL GAME SIDE WAGERING WITH PLAYER INCENTIVES

RELATED APPLICATIONS

This non-provisional patent application claims priority to U.S. Provisional Application Ser. No. 62/398,863, filed Sep. 23, 2016, the disclosure of which is hereby incorporated herein by reference as if set forth fully herein.

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming devices and casino gaming establishments are popular entertainment, attracting many users and visitors annually. In an effort to provide a satisfying gaming opportunity for their players while keeping their overhead costs to a minimum, casino operators have attempted to meet the projected playing needs of their players while simultaneously seeking to preserve resources required by superfluous machines, which, in turn, requires additional square footage to house such machines and the concomitant services to support the additional machines. Casinos may provide wager-based games in which one or more players can place a wager or bet on an outcome that is uncertain at the time the wager is made. Typically, casinos provide their patrons with a variety of different wager-based gaming opportunities including, for example, gaming machines (e.g., slot machines and/or other electronic gaming machines), table games (e.g., Blackjack, Roulette, Craps, Baccarat, Poker, etc.), etc.

In some wager-based games, a wager made by a player is accepted by a "house", which may be representative of a gaming establishment hosting the particular game, for example. If the outcome is realized, the house provides a payout based on the wager made in accordance with established rules governing the particular game. Many popular casino games (e.g., Blackjack, Roulette, Craps, Baccarat, etc.), fall into this category of wager-based games. In such games, payouts on player wagers are typically provided by the house when the player wins in accordance with the rules of the respective games, as may be the case if a player holds a hand (of playing cards) that beats the hand of a house dealer, or if the player successfully predicts the outcome of a random event associated with the roll of dice or the spinning of a wheel, for example.

In another form of wager-based games, wagers are made between multiple players of a game, played between players and not against a house. Such games may be referred to as player versus player ("pvp"). Some variations of the game of poker (e.g., Texas Hold'em, Seven Card Stud, Omaha, etc.) fall into this category of wager-based games. In such games, wagers may be made by players at various stages during the play of a hand, each player betting that he will "win" the hand in accordance with the rules of the particular game being played. At the completion of a hand, each winner is then generally entitled to at least a portion of all wagers made during the play of that hand. In these types of games, although a house does not typically participate by playing a hand, in games hosted by a gaming establishment, a portion of all wagers made during the play of the hand (i.e., a rake) may be collected by the house before payouts are distributed to each winner.

Generally speaking, wager-based games include both games of skill and games of chance. For example, a game of chance may be defined as a game that includes at least one element wherein a randomness affects the outcome of the game, either positively or negatively. For example, a typical slot game is a game of chance because the reels stop at randomly determined positions. On the other hand, a game of skill has at least one element wherein the player can intentionally affect the outcome of the game, in a known manner, either positively or negatively. The skill in such games may include strategy, physical skill, coordination, etc. For example, poker is considered to be a game of skill because the player decides what cards to hold, how to bet, whether to bluff, etc. The outcome for a game of skill may typically be dependent upon or affected by the skill level of the player (or players) participating in the game of skill. Conversely, the outcome for a game of chance typically has little or no dependence upon the skill level of the player (or players) participating in the game of chance.

Additional opportunities for wagering may be in the form of side wagering (also referred to as back betting, side betting, proxy betting, etc.) Systems for side wagering may be implemented in a casino gaming network. However, such systems may be subject to manipulation and/or collusion between players and side wagering bettors.

Usually, casino games are either pvp or against the house. Further, side betting or back wagering is usually limited to games against the house. Therefore, there is a continuing need to provide new category of games and provide exciting wagering opportunities for the players that also make such games enjoyable by the players and also provide casinos benefits to provide these games to the players.

SUMMARY

Some embodiments of the inventive concepts provide a wagering gaming system that offers bettors the opportunity to place wagers on players in a skill-based challenge and players in the skill-based challenge to receive awards based on the wagers placed on them. For example, bettors may place side wagers on players competing in skill-based challenges. Such skill-based challenges may include player versus player and/or player versus house games. The side wagers may be placed on the performance of individual players and/or teams of players. The players and/or teams of players may be informed of the side wager activities. In addition to any prizes that might be the result of the outcome of the skill-based challenge itself, a player may also be awarded a player award that is determined based on the side wagering activities. Such awards based on the side wagering activities of other players (kick back to the player) may encourage the player to attract additional side wagering activities as well as deter a player from colluding with the opponent(s) or one or more bettors participating in a side wager.

Some embodiments are directed to a gaming system that includes a processor, a display device, an input device and a memory device storing a plurality of instructions which, when executed by the processor, cause the processor to operate with the display device and the input device, for a play of a wagering game, to receive, from a bettor, a wager that corresponds to a selected player of multiple players in a skill-based challenge, to determine that the selected player has achieved a threshold outcome in the skill-based challenge, to award a bettor monetary prize to the bettor in response to the selected player achieving the threshold outcome in the skill-based game and to award a player monetary prize to the selected player, wherein the player monetary prize is based on the wager that is received from the bettor and based on the threshold outcome.

Some embodiments provide that the skill-based challenge includes a player versus player challenge that includes the selected player competing against another one of the players, wherein a performance of the selected player is determined relative to performances of other ones of the players, and wherein the threshold outcome is related to the performance of the selected player.

In some embodiments, the skill-based challenge includes a player versus house challenge, a performance of the selected player is independent of other ones of the players, and the threshold outcome is related to the performance of the selected player.

Some embodiments provide that the skill-based challenge includes a hybrid player versus house and player versus player challenge, and the threshold outcome is related to the performance of the selected player.

In some embodiments, the players include multiple teams of players and the selected player is on one of the teams of players. Some embodiments provide the selected player is on a selected team of the multiple teams, the wager corresponds to the selected team in the skill-based challenge, and the threshold outcome in the skill-based challenge is a team threshold outcome. In some embodiments, the wager corresponds to the selected player on the one team and the threshold outcome in the skill-based challenge is based on an individual performance of the selected player on the one team.

Some embodiments provide that the wager is a fixed odds based wager and that the instructions, when executed by the processor, cause the processor to determine an odds value before the skill-based challenge begins based on a skill evaluation corresponding to the selected player. In some embodiments, the instructions, when executed by the processor, cause the processor to determine an updated odds value during the skill-based challenge and the wager that corresponds to the selected player may be received during the skill-based challenge using the updated odds value.

In some embodiments, the wager is a pari-mutuel odds based wager and the instructions, when executed by the processor, cause the processor to determine an odds value based on wager activity of other bettors.

Some embodiments provide that the instructions, when executed by the processor, cause the processor to display wager performance corresponding to each of the players.

In some embodiments, the instructions, when executed by the processor, cause the processor to display player monetary prize data corresponding to each of the players.

Some embodiments provide the display device includes a public display device that displays data corresponding to performance of the players in the skill-based challenge, data corresponding to the bettor monetary prize, data corresponding to the player monetary prize, and/or data corresponding to the threshold outcome.

In some embodiments, the player monetary prize is a function of a quantity of wagers that have been received that correspond to the selected player.

Some embodiments provide that the player monetary prize is a function of a player-specific performance value that corresponds to the selected player and the player specific performance value includes a player skill rating and/or a player loyalty rating.

In some embodiments, the player monetary prize is based on a volume of wagers on the selected player.

Some embodiments provide that the player monetary prize is based on an amount of wagers received from all bettors corresponding to the skill-based challenge.

In some embodiments, the player monetary prize is an entry in a progressive jackpot game that provides the selected player a chance to win a progressive jackpot.

Some embodiments provide that the instructions, when executed by the processor, cause the processor to store and analyze player performance data to detect evidence of collusion. Some embodiments further include a database that is configured to store the player performance data and bettor performance data. In some embodiments, responsive to detecting evidence of collusion, the selected player and/or bettor is penalized.

In some embodiments, the threshold outcome includes multiple different threshold outcomes and the bettor monetary prize and/or the player monetary prize include multiple bettor monetary prizes and/or multiple player monetary prizes, respectively.

Some embodiments provide that awarding the player monetary prize is responsive to a threshold quantity of wagers corresponding to the selected player and/or an aggregate value of wagers corresponding to the selected player.

In some embodiments, the player monetary award is a function of revenue corresponding to multiple wagers that correspond to the players in the skill-based challenge.

Some embodiments provide that, responsive to the selected player not achieving the threshold outcome in the skill-based challenge, an amount corresponding to the player monetary prize is included in a prize pool. The instructions, when executed by the processor, may further cause the processor to award the selected player not achieving the threshold outcome a chance to win a portion of the prize pool.

In some embodiments, data that is received from the bettor and/or the selected player and/or data that is transmitted to the bettor and/or the selected player is received and/or transmitted via a mobile device.

Some embodiments provide that data that is received from the bettor and/or the selected player and/or data that is transmitted to the bettor and/or the selected player is received and/or transmitted via a wagering device.

Some embodiments of the inventive concept include a gaming system that includes a processor, a display device, an input device and a memory device storing multiple instructions which, when executed by the processor, cause the processor to operate with the display device and the input device, for a play of a wagering game, to receive, from multiple bettors, respective multiple wagers that correspond to selected players of multiple players in a multiplayer skill-based challenge. The processor may be further caused to determine that ones of the selected players have achieved a threshold outcomes in the skill-based challenge, award a bettor monetary prize to ones of the bettors in response to the corresponding selected players that achieve the threshold outcomes in the multiplayer skill-based game, and award ones of the selected players prizes that are based on the wagers that are received from the bettors and based on the threshold outcomes.

In some embodiments, the multiple players include multiple teams of players and the selected players are on ones of the teams of players. Some embodiments provide that the selected player is on a selected team of the multiple teams, the wager corresponds to the selected team in the skill-based challenge, and the threshold outcome in the skill-based challenge is a team threshold outcome.

In some embodiments, the wager corresponds to the selected player on the one team and the threshold outcome in the skill-based challenge is based on an individual performance of the selected player on the one team.

Some embodiments provide that the multiple wagers are a fixed odds based wagers and that the instructions, when executed by the processor, cause the processor to determine odds values before the skill-based challenge begins based on a skill evaluation corresponding to ones of the selected players.

In some embodiments, the wagers are pari-mutuel odds based wagers and the instructions, when executed by the processor, cause the processor to determine odds values based on wager activity of other ones of the plurality of bettors.

Some embodiments provide that the instructions, when executed by the processor, cause the processor to display wager performance corresponding to each of the players and each of the bettors.

Some embodiments are directed to methods for providing skill game side wagering with player incentives. Operations corresponding to such methods may include receiving, from a bettor, a wager that corresponds to a selected player of a plurality of players in a skill-based challenge, determining that the selected player has achieved a threshold outcome in the skill-based challenge, awarding a bettor monetary prize to the bettor in response to the selected player achieving the threshold outcome in the skill-based game, and awarding a player monetary prize to the selected player, wherein the player monetary prize is based on the wager that is received from the bettor and based on the threshold outcome.

In some embodiments, the wager is a fixed odds based wager and operations further include determining an odds value before the skill-based challenge begins based on a skill evaluation corresponding to the selected player.

Some embodiments further include determining an updated odds value during the skill-based challenge and provide that the wager that corresponds to the selected player may be received during the skill-based challenge using the updated odds value.

In some embodiments, the wager is a pari-mutuel odds based wager and operations include determining an odds value based on wager activity of other bettors.

Some embodiments include displaying wager performance corresponding to each of the players. Some embodiments include displaying player monetary prize data corresponding to each of the plurality of players. Some embodiments include storing and analyzing player performance data to detect evidence of collusion.

It is noted that aspects of the invention described with respect to one embodiment, may be incorporated in a different embodiment although not specifically described relative thereto. That is, all embodiments and/or features of any embodiment can be combined in any way and/or combination. These and other objects and/or aspects of the present invention are explained in detail in the specification set forth below.

BRIEF DESCRIPTION OF THE DRAWINGS

The accompanying figures are included to provide a further understanding of the present invention, and are incorporated in and constitute a part of this specification. The drawings illustrate some embodiments of the present invention and, together with the description, serve to explain principles of the present invention.

DETAILED DESCRIPTION

Figure 1:
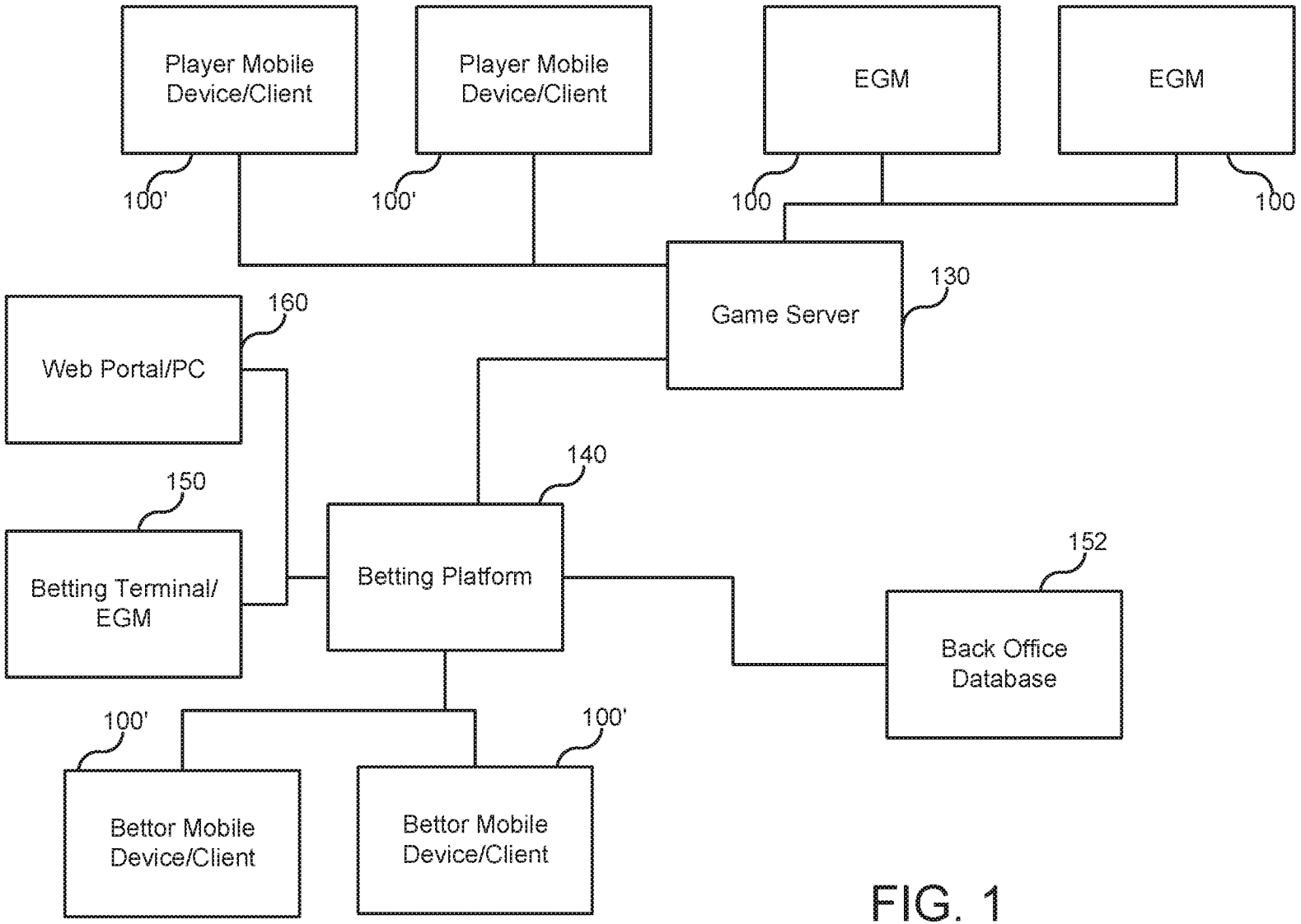
FIG. 1 is a block diagram illustrating a network configuration for a plurality of gaming devices according to some embodiments.

According to some embodiments, a side wagering bettor ("SWB") may participate in various side wagering activities via a gaming network that may include gaming devices such as electronic gaming machines, gaming tables, mobile devices, betting stations and/or kiosks, among others, which are operable to allow players at the gaming machines/gaming tables to participate in various side wagering activities. As used herein, the term "bettor" may be used interchangeably with the term SWB, which is distinguishable from the term "player", which refers to an individual or group thereof that are actively participating in a skill-based challenge. For example, in at least one embodiment, a player at a gaming device such as a gaming machine or gaming table is able to participate in various side wagering activities while concurrently being engaged in an active gaming session at that gaming machine/gaming table.

Some embodiments provide that the SWB may participate in wagering activities for a variety of casino games. Such casino games include traditional skill-based casino games such as poker and other skill based challenge games as well as non-traditional casino games that may attract players. Examples of non-traditional games include player-versus-player types of games including but not limited to electronic game machines, board games, and/or video games including virtual or game environments simulating battles and/or any other types of contests that involve player skill, arcade games, virtual sports, first person, driving games, etc. Players may compete as individuals and/or in team-based play. Side wagering opportunities may be provided on individual players and/or on player teams. For example, wagers may be placed on a team in a team-based challenge based on the performance of the individual player. Skill-based challenges may include player versus house skill games in which the wager corresponds to the player's performance relative to the house and thus is independent of other players of the skill-based challenge. Some embodiments provide that skill based challenges may include hybrid challenges in which players/teams are playing versus the house ("pvh") and versus other players/teams ("pvp") during the same round, session and/or tournament. Such challenges may provide SWB wagering opportunities in which the player performance in pvh game elements can influence the pvp outcomes and vice versa. In some embodiments, skill based challenges may be based on EGM's used in live tournament play. Some embodiments provide that skill based challenges may be conducted in real time, while other embodiments provide that the skill based challenges may be turn based, such as, for example, board game challenges such as chess, among others.

According to some embodiments, a side wager may be characterized as (or may be defined to include) the placing of a wager by a patron or bettor (e.g., by an SWB) on an event and/or activity, wherein the outcome of the event/activity is dependent, at least in part, upon the decisions and/or actions of a third party. For example, the third party may be a player in a skill-based challenge. Stated differently, a side wager may be characterized as relating to a gaming-related activity where the SWB is not an active player of the gaming activity and/or where the gaming activity is not under control of the SWB. Examples of side wagering implementations are further described in U.S. Patent Publication No. 2016/0196722, entitled "Distributed Side Wagering Methods And Systems," which is incorporated herein by reference.

In some embodiments, an SWB may place one or more side wagers on events which may be associated with various types of different targets. For example, in some embodiments, an SWB may place one or more side wagers on events (e.g., game play events, game outcome events, bonusing events, etc.) associated with one or more "target" players. Further, in some embodiments, an SWB may place one or more side wagers on events associated with one or more "target" gaming machines in the casino. In some embodiments, a side wager may be defined to include a wager placed by an SWB on an event relating to a game play activity being conducted by (or associated with) another player. In this regard, an SWB is a person who does not have control of game play decisions and/or wagering decisions relating to the game(s) being played by the other player(s) upon which the SWB has placed one or more side wagers.

As used herein, the term "bettor" may be used interchangeably with the term SWB, which is distinguishable from the term "player", which refers to an individual or group thereof that are actively participating the skill-based challenge. Embodiments of the inventive concepts provide hybrid skill- and chance-based electronic wagering games that provide an opportunity for bettors to place wagers on players in the skill-based challenge. The bettors may place wagers on selected players in player versus player challenges, player versus the house challenges and/or hybrid pvp/pvh challenges. Some embodiments provide that a side wager corresponds to a final outcome of the skill-based challenge and/or an intermediate and/or ancillary performance metric. For example, in the context of a first-person shooter game, a wager may be placed regarding the number of kills a player makes. Another example includes a wager based on how a player places or how much time a player is able to stay in the skill-based challenge without being eliminated. Another example includes a wager on a player winning a skill based challenge and/or tournament.

The side wagering opportunities may be publicly displayed including data regarding the players in the skill-based challenge, odds and/or terms corresponding to side wagering opportunities, and/or data corresponding to other bettors and/or side wagers. In some embodiments, the public display may be in the form of a leaderboard that is displayed in a public and/or area designated for the skill-based challenge. Some embodiments provide that the leaderboard may be displayed on mobile devices, web portals, terminals and/or kiosks, among others, where a bettor may place and review existing and prospective wagers.

The players in the skill-based challenge may be informed of the side wagering activities corresponding to their individual and/or team performance. For example, players may be encouraged to achieve specific goals or compete more strenuously based on encouragement from the side wagering activity. Additionally, players may be further incentivized by receiving a player monetary award that is based on the side wagering activity on them. In this regard, the players in the skill-based challenges may be incentivized to attract a large following of bettors. Additionally, by being awarded a player monetary award corresponding to the side wagering based on a winning and/or best result, the appeal and reward of collusion with bettors may be diminished.

By way of example, some embodiments provide that a side wager may correspond to the number of kills a player achieves in a first person shooter game. The player may still lose the game because he killed "easy" targets that may have low scoring values, but have the best result corresponding to the side wager. Such wagers may correspond to a particular session in comparison to other players in the battle. Additionally, such wagers may correspond to performance over multiple sessions and/or extended time periods such as weeks, months and/or total historical.

Some embodiments provide that a bettor can wager virtual currency that is earned in other wagering games with a chance of winning more virtual currency back. Such embodiments may provide non-gambling, non-regulated play. In such embodiments, players may earn virtual currency prizes based on the virtual currency side wagers. In some embodiments, the virtual currency may be used to purchase the boosts, enhancements and/or upgrades to enhance game play and/or to enhance chances of higher payouts through enhanced player skill. Some embodiments provide that the virtual currency could be earned in wagering games and/or non-wagering games (promotional/social games, for example).

Reference is now made to FIG. 1, which is a block diagram illustrating a network configuration for a plurality of gaming devices according to some embodiments. In some embodiments, a bettor mobile device/client 100', a betting terminal/EGM 150 and/or a web portal/PC 160 (such as, for example, wireless or handheld gaming and/or mobile telecommunication devices) may provide capability to allow a better to make side wagers (e.g., back bets) on games (and/or gaming activities) played by other players.

In some embodiments, the bettor may place one or more wagers (e.g., one or more even money wagers) on a selected player's game. For example, in one embodiment, the bettor may place an even money side wager on the outcome of a selected player's game. If the player wins or satisfies a threshold outcome, the bettor wins the amount that the bettor wagered on that game outcome. Additionally, the player may receive a player monetary award that corresponds to the betting activity of the bettor(s).

If the player loses, the bettor loses the amount that the bettor wagered on that game outcome. In some embodiments, side wagers may be queued up in advance. For example, in some embodiments, the bettor may identify and/or select (e.g., in advance) a plurality of games (e.g., yet to be played) for placing side wagers. The bettor may then specify individual side wager amounts for each of the identified games.

The network includes one or more electronic gaming machines (EGMs) 100 and/or one or player mobile device/clients 100' that may be communicatively coupled to a game server 130. The game server 130 may be operable to manage all aspects of the skill-based challenge for the players. For example, a skill-based challenge may be a multiperson challenge in which a plurality of players use independent terminals or machines to play the game. In some embodiments, the players may use EGM's 100 that are in a single casino and/or are at different casinos. Similarly, the players may interface with the game server 130 through player mobile devices/clients 100' that may be within the casino, at a different casino and/or not in a casino at all.

Some embodiments provide that the game server 130 keeps track of player statistics, including player experience, skill-level, skill rating and/or loyalty rating, among others. Additionally, the game server 130 may deliver and/or manage game content, keep statistics on each player and/or team, determine and/or assess skill level or rating, and determine events and/or outcomes of the skill-based challenge.

The game server 130 may communicate with a betting platform 140 that is operable to provide side wagering opportunities corresponding to the skill-based challenge. The betting platform may provide side wager information to potential bettors via a betting terminal/EGM 150, a web portal/PC 160 and/or a bettor mobile device/client 100'. Additionally, bettors may place side wagers on the skill-based challenge via a betting terminal/EGM 150, a web portal/PC 160 and/or a bettor mobile device/client 100'. For example, a side wager may be placed via any of an EGM 100, a kiosk, a PDA 100' (or other mobile or handheld device), an interactive gaming table display/interface, a casino attendant or employee, etc. The game server 130 and/or the betting platform 140 may include mobile interface functionality for providing thin client service to bettor and/or player mobile devices.

In some embodiments, player data and/or bettor data may be stored in a back office database 152. In such embodiments, the player and/or bettor data may be analyzed to detect evidence of collusion between a player and a bettor. In response to detecting evidence of collusion between a player and a bettor, penalties to the player and/or bettor may be imposed. For example, the player and/or bettor may be penalized by a reduction in player rating, suspended from playing or betting, and/or banned from playing and/or betting.

Some embodiments provide that players and/or bettors may be remote via a WAN or may be face-to-face in a local network. As discussed above, player terminals and/or bettor terminals may be fixed or mobile terminals that may be locally networked and/or may remotely connect to the network.

In some embodiments, the system will be used in conjunction with a loyalty system that will authenticate a user and allow them to bet. This may also allow per player tracking of bets (i.e. non-anonymous), eligibility of bet types, stake limits per bet type and game type as well as allowing the ability for an operator to ban, exclude or otherwise govern individual player betting activities.

Some embodiments provide that participating player betting may be provided from within the game itself inside the EGM 100 and/or from a mobile engine server if some or all of the players are participating from a mobile version of the game.

In some embodiments, skill-based challenge related odds may be generated both upfront (before game start) and in real time by the game server 130 and/or by the betting platform 140. For example, game engines for the main skill-based challenge may be generated and communicated to the betting platform 140. In some embodiments, in some embodiments, game engines for primary skill-based challenges may generate possible game outcomes and/or events that may include respective odds/probabilities that may be communicated in both real time and/or before the skill-based challenge is initiated to the betting platform. In some embodiments, the side wagering may use a sports betting platform and/or a service that is similar thereto to process and manage raw games odds and player performance statistics to produce the back bettor facing and player facing betting opportunities. In some embodiments, such odds may be sent to mobile devices, web portals, betting terminals, and/or EGM's 100, among others. Some embodiments provide that a sports betting platform, in the context of back betting may provide functions including creating side wagering opportunities based on operational rules and risk management protocols setup and managed in the platform), manage and derive odds for wagers, publish data to client systems such as portals and/or apps, accept, store and settle side wagers, and interface with player accounting and other systems.

Some embodiments provide that gaming devices in which players utilize EGMs 100 for playing slot/poker/skill/tournament/community/group games and bettors on other EGMs 100 making side wagers on the skill-based challenges. In some embodiments, wagers can be deducted from a credit meter and awarded to the players directly via credit meter. In some embodiments, players and bettors may be logged in using player tracking/casino wallet accounts and funds may be deducted from and/or credited to this account. In some embodiments, a service window application may be used to provide the side wager and player award functionality.

Some embodiments provide that players may use EGMs 100 for the skill-based challenge and bettors may use mobile devices 100' (on-premise type solution) for participating in the side wagering. In some embodiments, players may also use mobile devices 100' instead of or in addition to EGMs 100 and bettors may use mobile devices (on-premise type solution with gaming).

Although not illustrated, other components and/or systems may include, but are not necessarily limited to, promotion server(s), player tracking system(s), casino layout/physical environment system(s), wager tracking/accounting system, real-time data tracking system(s), bonus server(s), event notification system, and the like.

In some embodiments, a bettor may communicate with the betting platform 140 for conducting side wager related activity. According to different embodiments, different bettor client functionality may be incorporated into, or implemented by, for example, one or more of the following (or combinations thereof): an EGM, a kiosk, a PDA (or other mobile or handheld device), an interactive gaming table display/interface, a casino attendant or employee, etc.

For example, in some embodiments, using a bettor mobile device/client 100', a bettor may place a side wager relating to a selected player and/or skill-based challenge (e.g., player EGM 100, EGM player, gaming table player, etc.).

The betting platform 130 may be operable to facilitate and/or manage a variety of side wagering activities and/or related information which is conducted in the gaming network. According to some embodiments, the betting platform 140 may be operable to communicate with various other components and/or systems of the gaming network in order, for example, to carry out operations relating to its various functionalities.

In some embodiments, the betting platform 140 may be operable to implement or perform one or more of the following functions (and/or combinations thereof): perform authentication/verification of various entities (such as, for example, bettors, bettor devices, etc.); manage side wagers placed by bettors; instantiate/manage side wager sessions for one or more bettor; handle various accounting transactions relating to placed side wagers (such as, for example: verifying funds, deducting wagered amounts, issuing credits for wins, etc.); subscribe to selected event notifications at an event notification system; interpret game specific messages relating to game server play (e.g., via the use of plug-in type filters for specific game types/game themes); determine and/or interpret win/loss outcomes for placed side wagers, for example, by processing event notification information, among others.

In some embodiments, an EGM 100 and/or gaming system may be configured or designed to include functionality (e.g., via hardware and/or software) for monitoring changes in game states which occur at the EGM 100, and for generating suitable game state update information to be provided to the event notification system. According to some embodiments, the updated information may be dynamically generated and automatically provided to the event notification system on a periodic basis such as, for example, at regular intervals, upon the occurrence of specified triggering events/conditions, upon request.

In some embodiments, at least a portion of the updated game state/status information (which may be posted/reported to an event notification system) may be provided directly (and/or indirectly) from one or more game servers 130. Accordingly, in at least one embodiment, at least a portion of the updated information may be dynamically generated and automatically provided by one or more game servers 130 to an event notification system.

In some embodiments, various other devices/systems of the gaming network, such as, for example, the betting platform and/or various bettor devices clients may subscribe to receive periodic alerts and/or notifications from an event notification system regarding updated event information relating to changes in status/states of game play activity, wagering activity, player activity, etc. for selected EGMs 100, among others.

It will be appreciated that the various side wagering techniques described herein combined with player awards may allow for new types of wagering opportunities (e.g., side wagering opportunities) to be available to active players at gaming tables, EGMs 100, and/or other skill-based challenges.

Electronic Gaming Machines

Figure 2A:
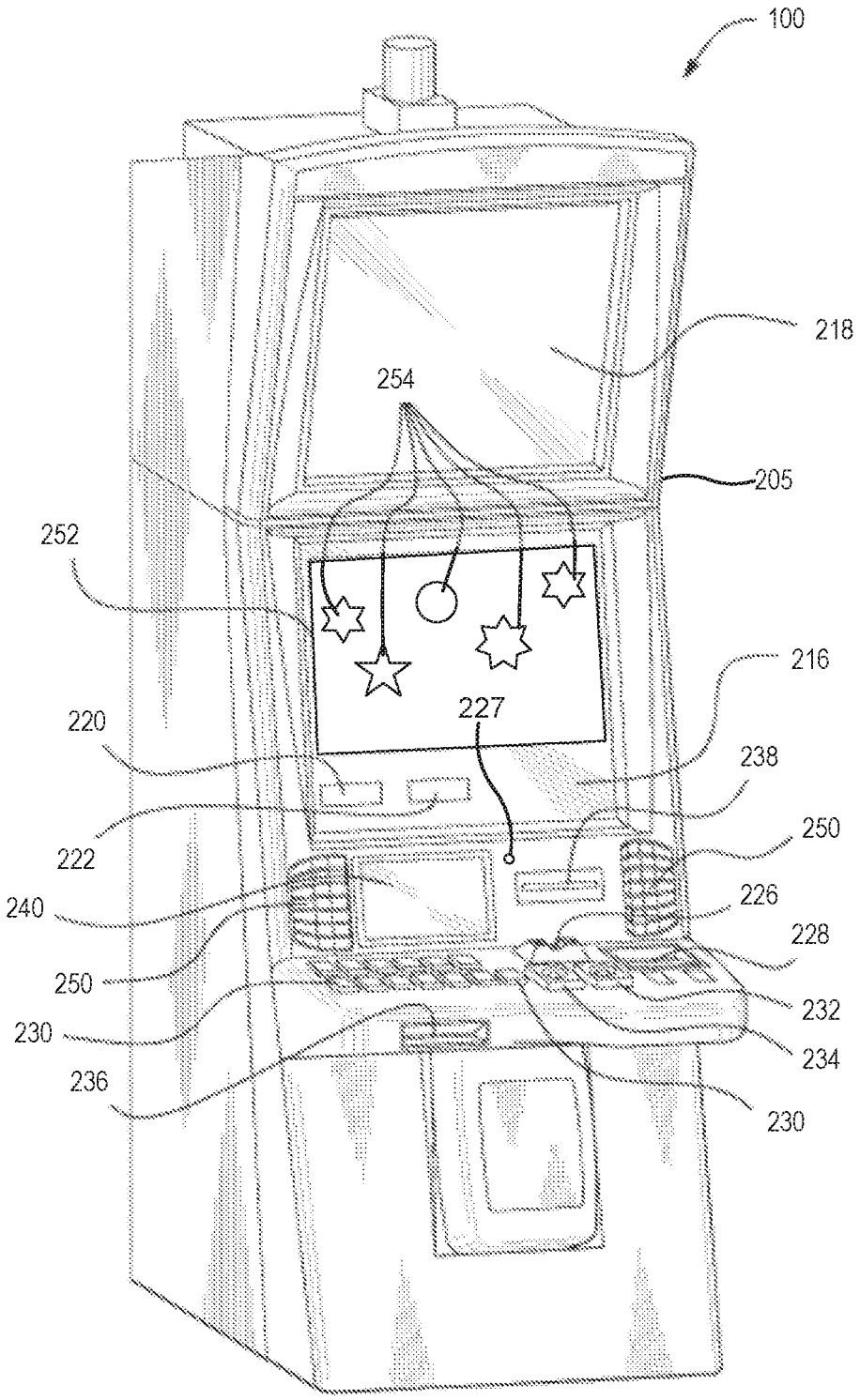
FIG. 2A is a perspective view of an electronic gaming device that can be configured according to some embodiments.
Figure 2B:
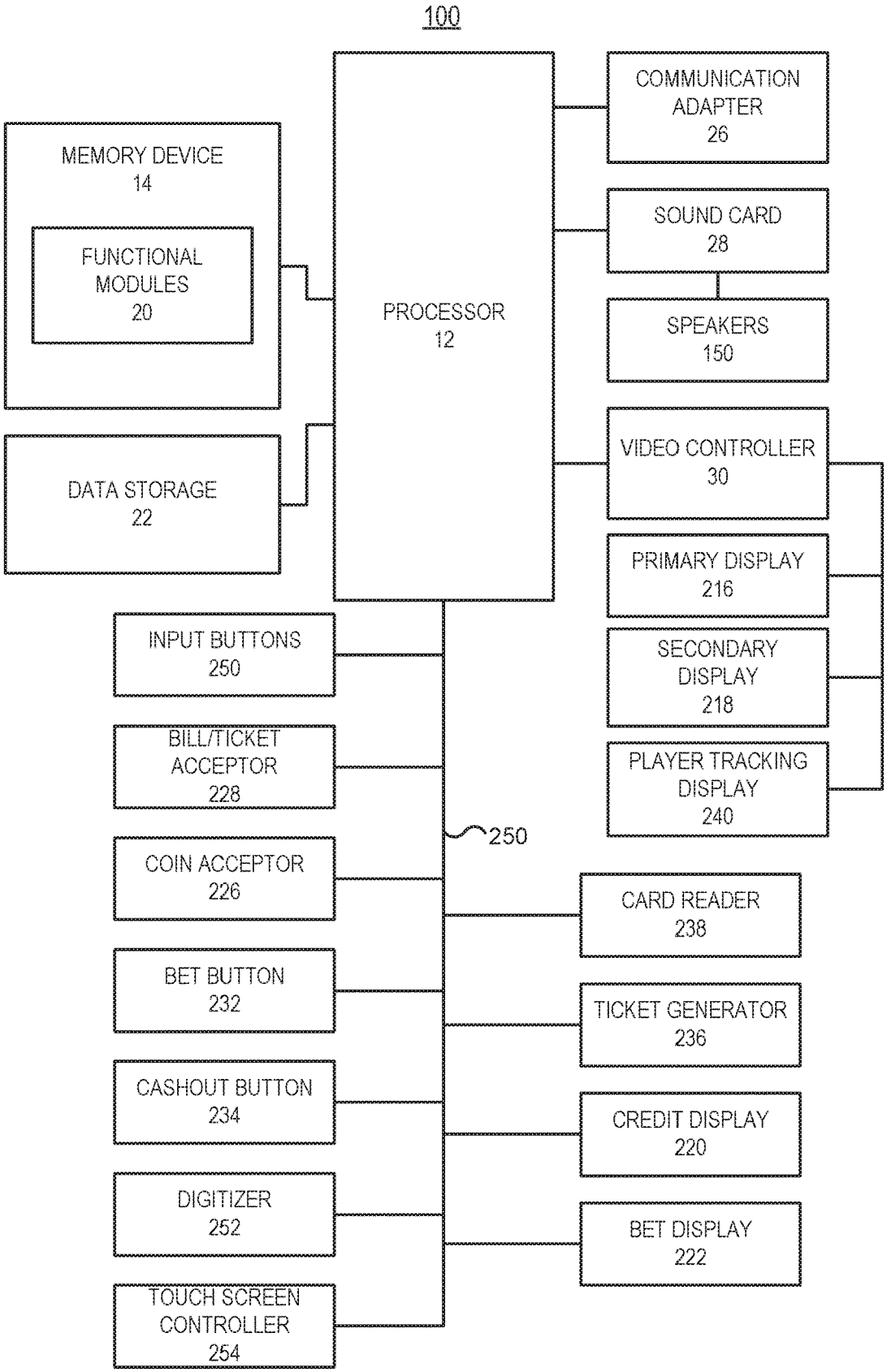
FIG. 2B is a schematic block diagram illustrating an electronic configuration for a gaming device according to some embodiments.
Figure 2C:
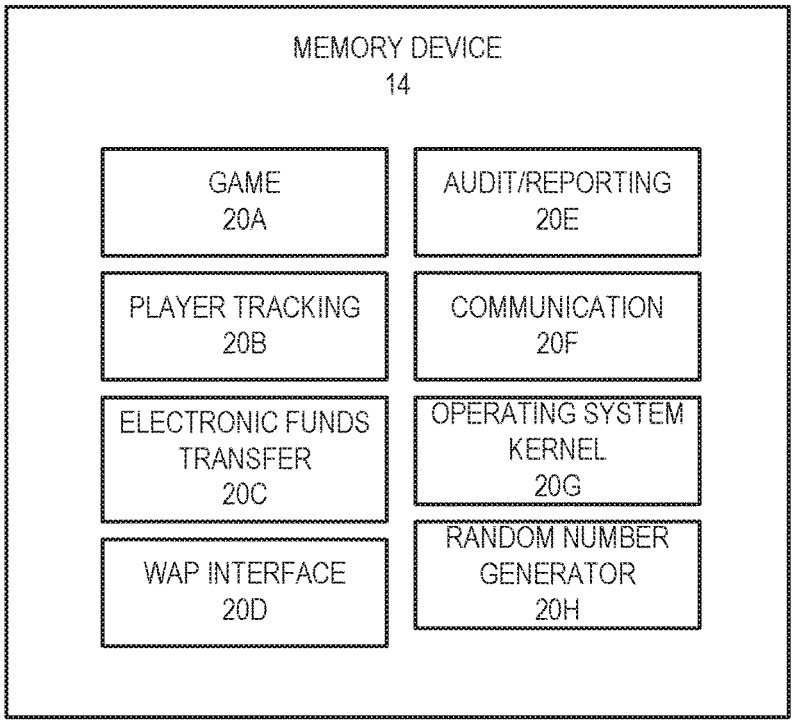
FIG. 2C is a block diagram that illustrates various functional modules of an electronic gaming device according to some embodiments.

An example of an electronic gaming machine (EGM) that can host skill based challenges and side wagering opportunities according to various embodiments is illustrated in FIGS. 2A, 2B, and 2C in which FIG. 2A is a perspective view of an EGM 100 illustrating various physical features of the device, FIG. 2B is a functional block diagram that schematically illustrates an electronic relationship of various elements of the EGM 100, and FIG. 2C illustrates various functional modules that can be stored in a memory device of the EGM 100. The embodiments shown in FIGS. 2A to 2C are provided as examples for illustrative purposes only. It will be appreciated that EGMs may come in many different shapes, sizes, layouts, form factors, and configurations, and with varying numbers and types of input and output devices, and that embodiments of the inventive concepts are not limited to the particular EGM structures described herein.

EGMs typically include a number of standard features, many of which are illustrated in FIGS. 2A and 2B. For example, referring to FIG. 2A, an EGM 100 may include a support structure, housing or cabinet 105 which provides support for a plurality of displays, inputs, outputs, controls and other features that enable a player to interact with the EGM 100.

The EGM 100 illustrated in FIG. 2A includes a number of display devices, including a primary display device 216 located in a central portion of the cabinet 205 and a secondary display device 218 located in an upper portion of the cabinet 205. It will be appreciated that one or more of the display devices 216, 218 may be omitted, or that the display devices 216, 218 may be combined into a single display device. The EGM 100 may further include a player tracking display 240, a credit display 220, and a bet display 222. The credit display 220 displays a player's current number of credits, cash, account balance or the equivalent. The bet display 222 displays a player's amount wagered.

The player tracking display 240 may be used to display a service window that allows the player to interact with, for example, their player loyalty account to obtain features, bonuses, comps, etc. In other embodiments, additional display screens may be provided beyond those illustrated in FIG. 1A.

The EGM 100 may further include a number of input devices that allow a player to provide various inputs to the EGM 100, either before, during or after a game has been played. For example, the EGM 100 may include a plurality of input buttons 230 that allow the player to select options before, during or after game play. The EGM may further include a game play initiation button 232 and a cashout button 234. The cashout button 234 is utilized to receive a cash payment or any other suitable form of payment corresponding to a quantity of remaining credits of a credit display.

In some embodiments, one or more input devices of the EGM 100 are one or more game play activation devices that are each used to initiate a play of a game on the EGM 100 or a sequence of events associated with the EGM 100 following appropriate funding of the EGM 100. The example EGM 100 illustrated in FIGS. 2A and 2B includes a game play activation device in the form of a game play initiation button 232. It should be appreciated that, in other embodiments, the EGM 100 begins game play automatically upon appropriate funding rather than upon utilization of the game play activation device.

In some embodiments, one or more input devices of the EGM 100 are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In some embodiments, one or more of the display screens may a touch-sensitive display that includes a digitizer 252 and a touchscreen controller 254 (FIG. 2B). The player may interact with the EGM 100 by touching virtual buttons on one or more of the display devices 216, 218, 240. Accordingly, any of the above described input devices, such as the input buttons 230, the game play initiation button 232 and/or the cashout button 234 may be provided as virtual buttons on one or more of the display devices 216, 218, 240.

Referring briefly to FIG. 2B, operation of the primary display device 216, the secondary display device 218 and the player tracking display 240 may be controlled by a video controller 30 that receives video data from a processor 12 or directly from a memory device 14 and displays the video data on the display screen. The credit display 220 and the bet display 222 are typically implemented as simple LCD or LED displays that display a number of credits available for wagering and a number of credits being wagered on a particular game. Accordingly, the credit display 220 and the bet display 222 may be driven directly by the processor 12. In some embodiments however, the credit display 220 and/or the bet display 222 may be driven by the video controller 30.

Referring again to FIG. 2A, the display devices 216, 218, 240 may include, without limitation: a cathode ray tube, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device 216, 218, 240 may includes a touch-screen with an associated touch-screen controller 254 and digitizer 252. The display devices 216, 218, 240 may be of any suitable size, shape, and/or configuration. The display devices 216, 218, 240 may include flat or curved display surfaces.

The display devices 216, 218, 240 and video controller 30 of the EGM 100 are generally configured to display one or more game and/or non-game images, symbols, and indicia. In certain embodiments, the display devices 216, 218, 240 of the EGM 100 are configured to display any suitable visual representation or exhibition of the movement of objects; dynamic lighting; video images; images of people, characters, places, things, and faces of cards; and the like. In certain embodiments, the display devices 216, 218, 240 of the EGM 100 are configured to display one or more virtual reels, one or more virtual wheels, and/or one or more virtual dice. In other embodiments, certain of the displayed images, symbols, and indicia are in mechanical form. That is, in these embodiments, the display device 216, 218, 240 includes any electromechanical device, such as one or more rotatable wheels, one or more reels, and/or one or more dice, configured to display at least one or a plurality of game or other suitable images, symbols, or indicia.

The EGM 100 also includes various features that enable a player to deposit credits in the EGM 100 and withdraw credits from the EGM 100, such as in the form of a payout of winnings, credits, etc. For example, the EGM 100 may include a ticket dispenser 236 that is configured to generate and provide a ticket or credit slip representing a payout and/or a credit balance. The ticket or credit slip is printed by the EGM 100 when the cashout button 234 is pressed, and typically includes a barcode or similar device that allows the ticket to be redeemed via a cashier, a kiosk, or other suitable redemption system, or to be deposited into another gaming machine. The EGM 100 may further include a bill/ticket acceptor 228 that allows a player to deposit credits in the EGM 100 in the form of paper money or a ticket/credit slip, and a coin acceptor 226 that allows the player to deposit coins into the EGM 100.

While not illustrated in FIG. 2A, the EGM 100 may also include a note dispenser configured to dispense paper currency and/or a coin generator configured to dispense coins or tokens in a coin payout tray.

The EGM 100 may further include one or more speakers 250 controlled by one or more sound cards 28 (FIG. 2B). The EGM 100 illustrated in FIG. 2A includes a pair of speakers 250. In other embodiments, additional speakers, such as surround sound speakers, may be provided within or on the cabinet 205. Moreover, the EGM 100 may include built-in seating with integrated headrest speakers.

In various embodiments, the EGM 100 may generate dynamic sounds coupled with attractive multimedia images displayed on one or more of the display devices 216, 218, 240 to provide an audio-visual representation or to otherwise display full-motion video with sound to attract players to the EGM 100 and/or to engage the player during gameplay. In certain embodiments, the EGM 100 may display a sequence of audio and/or visual attraction messages during idle periods to attract potential players to the EGM 100. The videos may be customized to provide any appropriate information.

The EGM 100 may further include a card reader 238 that is configured to read magnetic stripe cards, such as player loyalty/tracking cards, chip cards, and the like. In some embodiments, a player may insert an identification card into a card reader of the gaming device. In some embodiments, the identification card is a smart card having a programmed microchip or a magnetic strip coded with a player's identification, credit totals (or related data) and other relevant information. In other embodiments, a player may carry a portable device, such as a cell phone, a radio frequency identification tag or any other suitable wireless device, which communicates a player's identification, credit totals (or related data) and other relevant information to the gaming device. In some embodiments, money may be transferred to a gaming device through electronic funds transfer. When a player funds the gaming device, the processor determines the amount of funds entered and displays the corresponding amount on the credit or other suitable display as described above.

In some embodiments, the EGM 100 may include an electronic payout device or module configured to fund an electronically recordable identification card or smart card or a bank or other account via an electronic funds transfer to or from the EGM 100.

FIG. 2B is a block diagram that illustrates logical and functional relationships between various components of an EGM 100. As shown in FIG. 2B, the EGM 100 may include a processor 12 that controls operations of the EGM 100. Although illustrated as a single processor, multiple special purpose and/or general purpose processors and/or processor cores may be provided in the EGM 100. For example, the EGM 100 may include one or more of a video processor, a signal processor, a sound processor and/or a communication controller that performs one or more control functions within the EGM 100. The processor 12 may be variously referred to as a "controller," "microcontroller," "microprocessor" or simply a "computer." The processor may further include one or more application-specific integrated circuits (ASICs).

Various components of the EGM 100 are illustrated in FIG. 2B as being connected to the processor 12. It will be appreciated that the components may be connected to the processor 12 through a system bus, a communication bus and controller, such as a USB controller and USB bus, a network interface, or any other suitable type of connection.

The EGM 100 further includes a memory device 14 that stores one or more functional modules 20. Various functional modules 20 of the EGM 100 will be described in more detail below in connection with FIG. 2D.

The memory device 14 may store program code and instructions, executable by the processor 12, to control the EGM 100. The memory device 14 may also store other data such as image data, event data, player input data, random or pseudo-random number generators, pay-table data or information and applicable game rules that relate to the play of the gaming device. The memory device 14 may include random access memory (RAM), which can include non-volatile RAM (NVRAM), magnetic RAM (MRAM), ferro-electric RAM (FeRAM) and other forms as commonly understood in the gaming industry. In some embodiments, the memory device 14 may include read only memory (ROM). In some embodiments, the memory device 14 may include flash memory and/or EEPROM (electrically erasable programmable read only memory). Any other suitable magnetic, optical and/or semiconductor memory may operate in conjunction with the gaming device disclosed herein.

The EGM 100 may further include a data storage device 22, such as a hard disk drive or flash memory. The data storage 22 may store program data, player data, audit trail data or any other type of data. The data storage 22 may include a detachable or removable memory device, including, but not limited to, a suitable cartridge, disk, CD ROM, DVD or USB memory device.

The EGM 100 may include a communication adapter 26 that enables the EGM 100 to communicate with remote devices over a wired and/or wireless communication network, such as a local area network (LAN), wide area network (WAN), cellular communication network, or other data communication network. The communication adapter 26 may further include circuitry for supporting short range wireless communication protocols, such as Bluetooth and/or near field communications (NFC) that enable the EGM 100 to communicate, for example, with a mobile communication device operated by a player.

The EGM 100 may include one or more internal or external communication ports that enable the processor 12 to communicate with and to operate with internal or external peripheral devices, such as eye tracking devices, position tracking devices, cameras, accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumb drives, ticket readers, touch screens, trackballs, touchpads, wheels, and wireless communication devices. In some embodiments, internal or external peripheral devices may communicate with the processor through a universal serial bus (USB) hub (not shown) connected to the processor 12. U.S. Patent Application Publication No. 2004/0254014 describes a variety of EGMs including one or more communication ports that enable the EGMs to communicate and operate with one or more external peripherals.

In some embodiments, the EGM 100 may include a sensor, such as a camera in communication with the processor 12 (and possibly controlled by the processor 12) that is selectively positioned to acquire an image of a player actively using the EGM 100 and/or the surrounding area of the EGM 100. In one embodiment, the camera may be configured to selectively acquire still or moving (e.g., video) images and may be configured to acquire the images in either an analog, digital or other suitable format. The display devices 216, 218, 240 may be configured to display the image acquired by the camera as well as display the visible manifestation of the game in split screen or picture-in-picture fashion. For example, the camera may acquire an image of the player and the processor 12 may incorporate that image into the primary and/or secondary game as a game image, symbol or indicia.

Various functional modules of that may be stored in a memory device 14 of an EGM 100 are illustrated in FIG. 2C. Referring to FIG. 2C, the EGM 100 may include in the memory device 14 a game module 20A that includes program instructions and/or data for operating a hybrid wagering game as described herein. The EGM 100 may further include a player tracking module 20B, an electronic funds transfer module 20C, a wide area progressive module 20D, an audit/reporting module 20E, a communication module 20F, an operating system 20G and a random number generator 20H. The player tracking module 20B keeps track of the play of a player. The electronic funds transfer module 20C communicates with a back end server or financial institution to transfer funds to and from an account associated with the player. The wide area progressive (WAP) interface module 20D interacts with a remote WAP server to enable the EGM 100 to participate in a wide area progressive jackpot game as described in more detail below. The communication module 20F enables the EGM 100 to communicate with remote servers and other EGMs using various secure communication interfaces. The operating system kernel 20G controls the overall operation of the EGM 100, including the loading and operation of other modules. The random number generator 20H generates random or pseudorandom numbers for use in the operation of the hybrid games described herein.

In some embodiments, an EGM 100 may be implemented by a desktop computer, a laptop personal computer, a personal digital assistant (PDA), portable computing device, or other computerized platform. In some embodiments, the EGM 100 may be operable over a wireless network, such as part of a wireless gaming system. In such embodiments, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission.

Figure 2D:
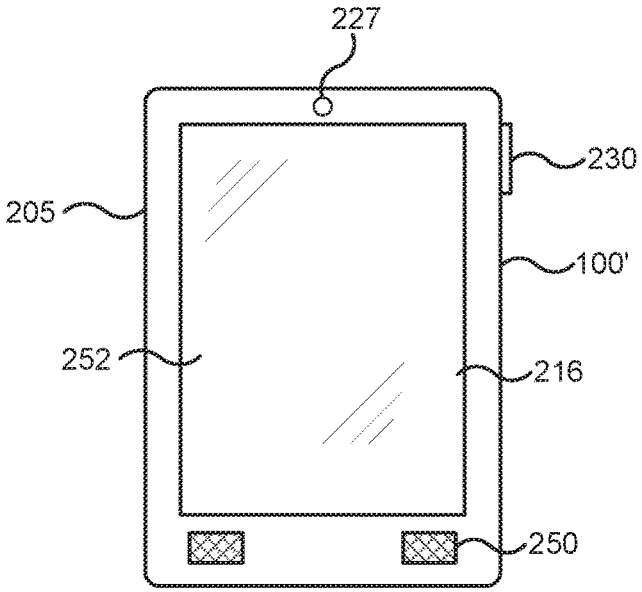
FIG. 2D is perspective view of a handheld electronic gaming device that can be configured according to some embodiments.

For example, referring to FIG. 2D, an EGM 100' may be implemented as a handheld device including a compact housing 205 on which is mounted a touchscreen display device 216 including a digitizer 252. An input button 230 may be provided on the housing and may act as a power or control button. A camera 227 may be provided in a front face of the housing 205. The housing 205 may include one or more speakers 250. In the EGM 100', various input buttons described above, such as the cashout button, gameplay activation button, etc., may be implemented as soft buttons on the touchscreen display device 216. Moreover, the EGM 100' may omit certain features, such as a bill acceptor, a ticket generator, a coin acceptor or dispenser, a card reader, secondary displays, a bet display, a credit display, etc. Credits can be deposited in or transferred from the EGM 100' electronically.

Figure 2E:
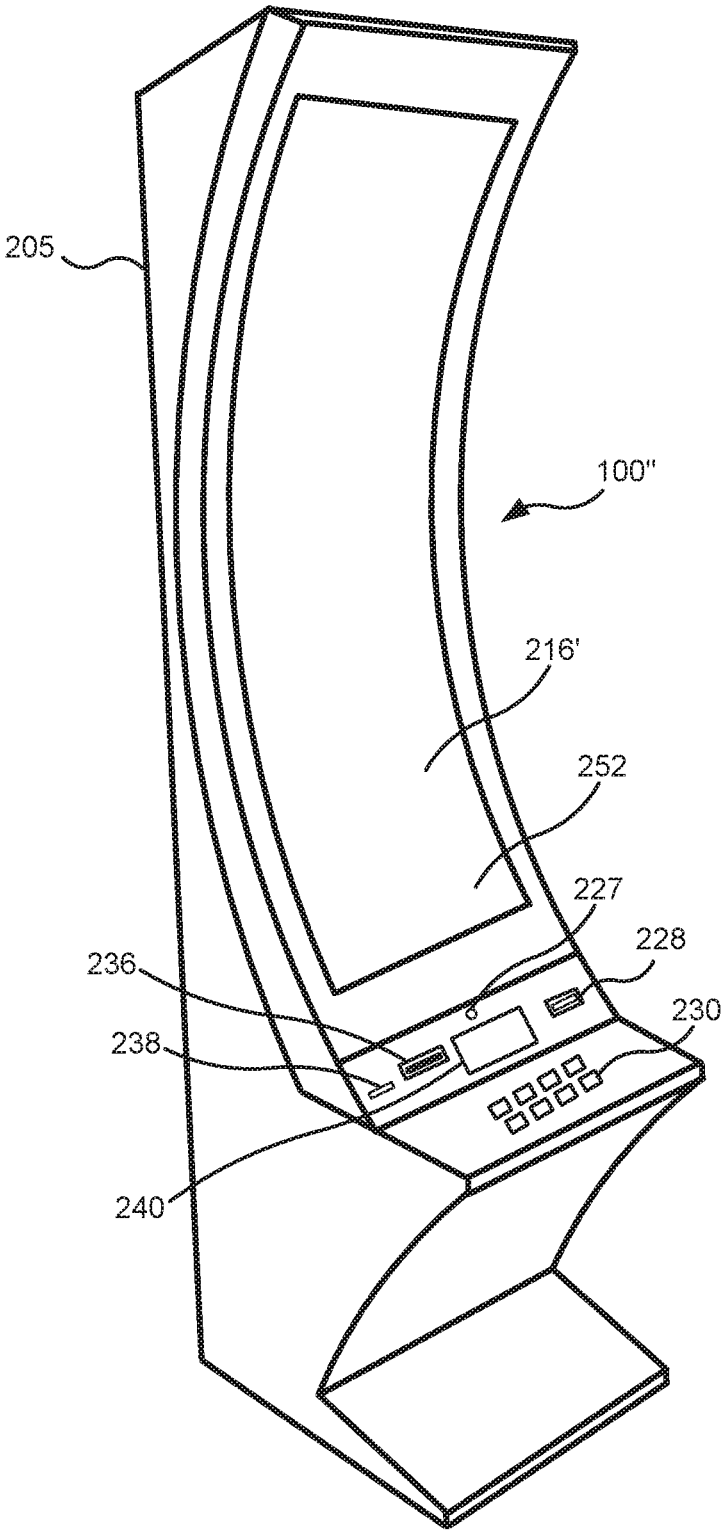
FIG. 2E is a perspective view of an electronic gaming device according to some embodiments.

FIG. 2E illustrates a standalone EGM 100" having a different form factor from the EGM 100 illustrated in FIG. 2A. In particular, the EGM 100" is characterized by having a large, high aspect ratio, curved primary display device 216' provided in the housing 205, with no secondary display device. The primary display device 216' may include a digitizer 252 to allow touchscreen interaction with the primary display device 216'. The EGM 100" may further include a player tracking display 240, a plurality of input buttons 230, a bill/ticket acceptor 228, a card reader 238, and a ticket generator 236. The EGM 100" may further include one or more cameras 227 to enable facial recognition and/or motion tracking.

Figure 3:
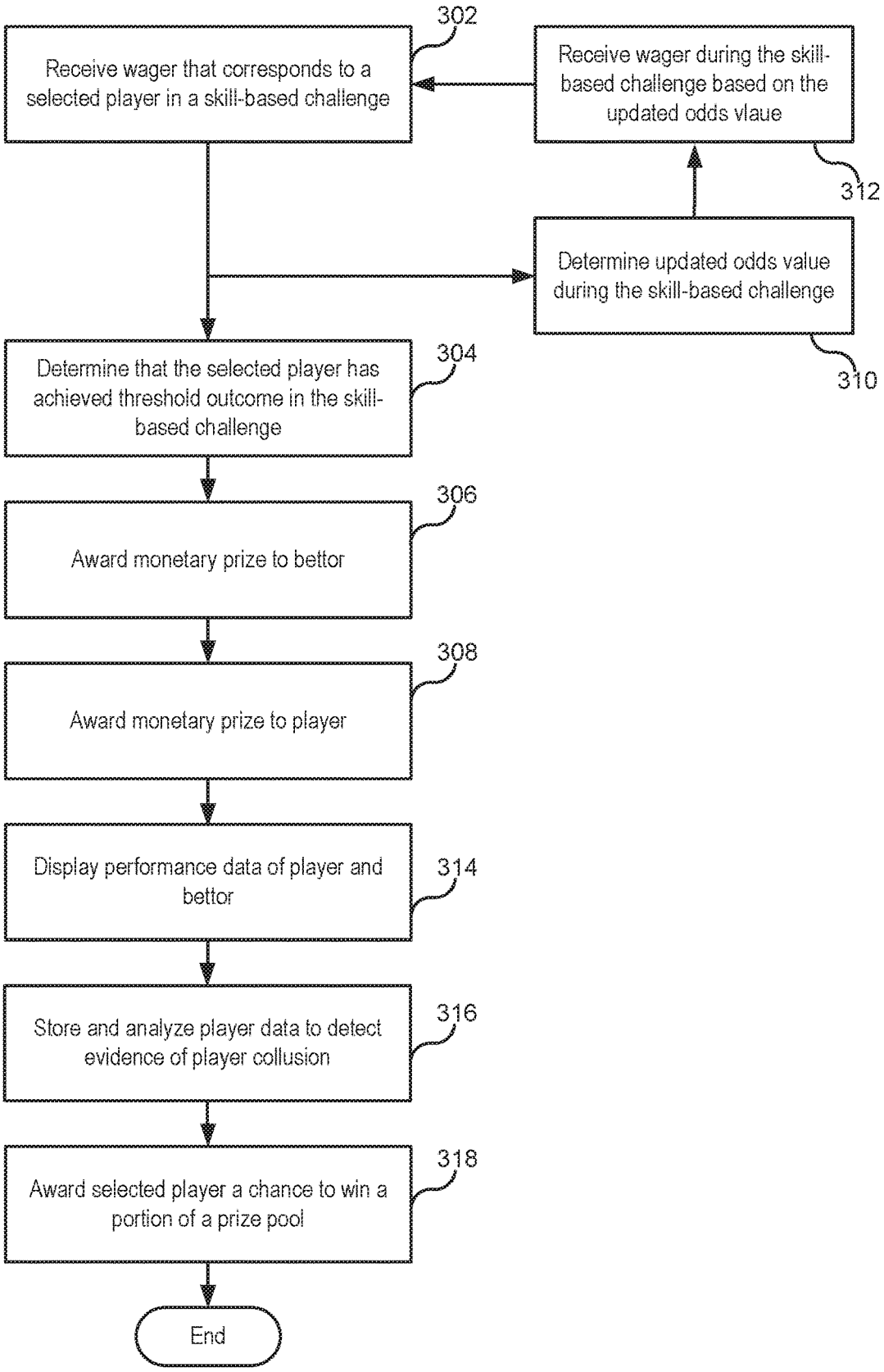
FIG. 3 is a process flow diagram illustrating operations of systems/methods according to some embodiments.

Reference is now made to FIG. 3, which is a process flow diagram illustrating operations of systems/methods according to some embodiments. Some embodiments provide that a wager is received from a bettor (block 302). The wager may correspond to a selected player and/or group of players, such as a team, participating in a skill-based challenge. Skill based challenges may include games such as skill games, such as player v. player skill games, player v. house skill games and hybrid pvp/pvh challenges.

The games may include individually played skill games and/or team based skill games. Some embodiments provide that bettors may bet on performance of individuals within a team v. team contest. For example, a wager may be based on a threshold number of kills in a team based shooter game. In some embodiments, the skill-based challenge is between multiple teams of players. Some embodiments provide that the selected player is an individual player on one of the teams. In some embodiments, the selected player is one of the teams of players.

The odds corresponding to a particular wager may be determined as a function of the skill level of the selected player. In some embodiments, skill evaluation may be based on an algorithm, current skill evaluation, and/or past performance. Some embodiments provide that the wager is a fixed odds based wager such that a betting platform, game server and/or EGM may determine an odds value before the skill-based challenge begins based on a skill evaluation corresponding to the selected player. In some embodiments, in the context of fixed odds, real time odds may be generated at the beginning of the skill-based challenge based on the skill evaluation and may be adjusted during the game for future bettors and/or wagers.

In some embodiments, the wager may be a pari-mutuel odds based wager in which an odds value may be determined based on wagering activity of other bettors. For example, the odds may be determined based on an aggregate amount of betting corresponding to the skill-based challenge.

Operations include determining that the selected player has achieved a threshold outcome in the skill-based challenge (block 304). The threshold outcome may include different metrics that can be determined relative to other ones of the players and/or independent of other ones of the players in the skill-based challenge. For example, a threshold outcome may be a ranking or placing in a contest of a team and/or an individual player. Additionally, internal metrics such as points or other game specific achievements may be used to determine that the selected player as achieved the threshold outcome. Some embodiments provide that the threshold outcome includes multiple different threshold outcomes, each corresponding to different metrics and/or odds values.

A monetary prize may be awarded to the bettor in response to the selected player achieving the threshold outcome in the skill-based game (block 306). Some embodiments provide that, in the context of fixed odds side wagers, a bettor monetary prize may be based on the results of their side wager, the amount they staked in the side wager and the odds given at the time the wager was received. Some embodiments provide that these wagers and their corresponding odds may be determined by the skill-based challenge and may change over time. For example, either the odds themselves, the maximum and minimum eligible amounts that can be wagered and/or the overall availability of a wager may change.

Some embodiments provide that bettors making side wagers may contribute their wagers into pools. In some embodiments, the pools may be created for identical bet types. Once the outcome of the wager is determined, the pool values may be raked to contribute profit to the house and/or player kickback percentages to the eligible players. Then the result may be divided and distributed to the winning bettors.

Some embodiments provide that wagers offered can be single wagers or part of a chain, which may be referred to as an accumulator. An accumulator may be a wager that combines multiple wager selections into a single wager that gains a return only when all parts of the wager win.

A player monetary prize may be awarded to the selected player (block 308). Some embodiments provide that the player monetary prize is based on the wager that is received from the bettor and/or the threshold outcome. Winning players or teams may receive a "kick-back percentage" of back bets made on him/her. In some embodiments, non-winning players may receive lower percentages of bets made on them or none at all. Some embodiments provide that a kick-back percentage may change based on a skill level and/or player rating (or group of players overall level/rating) and/or a gaming event type that may be defined by an operator based on their business objectives. In some embodiments, the kick-back percentage may change based on a volume of wagers made and/or the total value of the wagers made, either aggregated wagers, hold wagers, projected wagers or calculated wagers. Some embodiments provide that the kick-back percentage may change based on other rules including those corresponding to a progressive jackpot or other pool based devices being present in a game design.

Some embodiments provide that the amount of wagers and/or the odds corresponding to a player or group/team of players may be determined based on past performance or skill rating and may be static or dynamic, depending on current performance. In some embodiments, additional wagers may be made regarding stages or rounds of the game or player strength at certain points in the game. For example, a wager may correspond to whether a player survives advances to a next round and the odds may be dynamically provided based on that player's current performance.

In some embodiments, the player prize for a national/nationwide event may have higher percentages to the players and/or teams because of increased public interest and wagering liquidity. For example, a player/group of players may be rewarded when the value and/or quantity of wagers for him/them meet a certain threshold. Different percentages of kick back may be triggered at different values and/or number of bettor thresholds. A player/team/group of players may be awarded a certain percentage of side wager revenue that exceeds a threshold. By means of a suitable rewarding scheme, player collusion may be counteracted and thus honesty may be encouraged.

Some embodiments provide that according to certain games rules or thresholds being met, a losing teams' kick-backs (or portion thereof) can be funneled into a progressive fund or pot to be won later either in the same game round or in another eligible game session, perhaps by different players or teams. In some embodiments, a player or team or group may also be awarded entry (or multiple entries) into the aforementioned progressive jackpot/pool draw based on the quantity and/or amount of back bets on the player or group of players, and/or their performance in the game itself.

In some embodiments, a player or a team or group of players may be rewarded with direct monetary contribution based on side wagers. For example, a player or a team or group of players may be rewarded with opportunities to win a pool and/or share thereof. In some embodiments, a percentage of all side wagers on a game or game series may be allocated for a pool or pools that a player or group of players may have a chance of winning. The chance of winning the pool and/or a portion thereof may be improved based on the player's or team's performance in the game or game series. For example, the players may be awarded free spins based on side wagers and/or game performance, these awards could be based on a positive or negative performance, based on the game's design.

Some embodiments provide that a player may be rewarded with additional resources within the skill-based challenge. For example, life, energy, tools, ammunition, skills, strength, wild cards, and/or credits, among others, may be improved or added based on side wagering. Some embodiments provide that the player prize is a function of a player-specific performance value such as a player skill rating and/or a player loyalty rating.

In some embodiments, an updated odds value may be determined during the skill-based challenge (block 310). For example, changes in player performance, types of wagers, etc. may cause the odds corresponding to a particular wager to be updated. Using the updated odds, wagers may be received during the skill-based challenge (block 312).

Some embodiments include informing the player of the side wagering and of the player prize (kick-back) opportunities. Some embodiments provide that the amount of side wagering may be displayed to the players, bettors and/or potential bettors before and/or during game play (block 314). This may increase excitement in the game, which can encourage more side wagers. In some embodiments, a leaderboard may be generated that displays real-time and/or historical player performance and/or side wagers. Some embodiments provide that successful bettors may receive public recognition. In some embodiments, live game play of the skill-based challenge may be streamed to bettors and/or displayed on a monitor at local or remote locations. The display may show wager performance corresponding to each of the players, player monetary prize data corresponding to each of the players, data corresponding to the bettor monetary prize, and/or data corresponding to one or more threshold outcomes.

Some embodiments include storing and analyzing player performance data to detect evidence of collusion (block 316). The storing and analyzing may be performed to detect evidence of collusion between players and/or between players and bettors.

Some embodiments provide that responsive to the selected player not achieving the threshold outcome in the skill-based challenge, an amount of the side wager corresponding to what would have been the player monetary prize may be included in a prize pool. In some embodiments, the selected player is awarded a chance to win a portion of the prize pool (block 318). In this manner, there may be opportunities for a player to be rewarded for generating the side wagering interest even if the selected player does not achieve the threshold outcome. In some embodiments, side wagers that are based on individual player performance may be independent of whether or not the corresponding team wins or loses. For example, a player on a losing team may still receive player monetary prize based on a side wager.

In some embodiments, the player prize may include skill enhancements that may be used in current and future gaming sessions. These skill enhancements are sometimes referred to as "boosts." Boosts may provide an important driver for adoption and retention of players of skill-based challenges that have a story or narrative driven progression (SDP). In general, a boost is anything that influences a game's outcome in the player's favor. This may include an ability upgrade, a tool, a feature, or any other property or item that improves player performance. In a multiplayer/tournament/community mode this could affect another "less progressed" player's outcome to benefit the user of the boost in a competitive environment. A boost can also benefit other player's outcomes in a cooperative or team environment.

In some cases, a boost may unlock levels, zones or tools that have new, different features. In some embodiments, a boost may include something that provides emotional or social value to a player that does not have any effect on the player's ability to perform in the game, such as visual/custom upgrades to their in-game characters, new skins, bonus levels that are re-skins of already playable levels, characters that are re-skins of existing characters, etc.

When achieved/unlocked/purchased/awarded, boosts may be used and consumed and/or stored against a players account to be active across channels in the same game. In particular embodiments, once a boost has been unlocked, the boost may be permanently active for that player in a specific game. Some boosts can be awarded as a "comp" as part of a player loyalty program.

Figure 4:
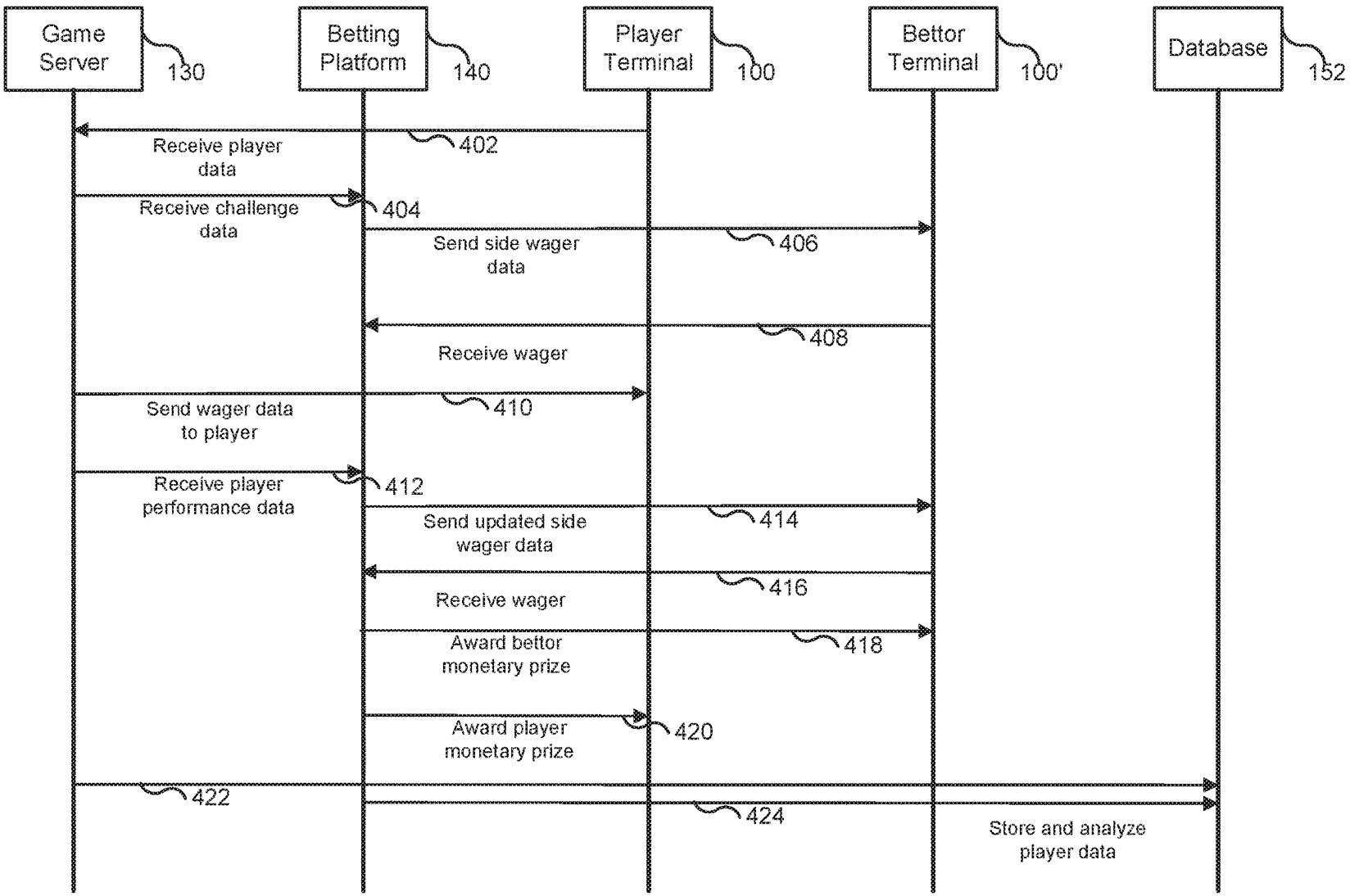
FIG. 4 is a block diagram illustrating data flow and operations corresponding to some embodiments.

Brief reference is now made to FIG. 4, which is a block diagram illustrating data flow and operations corresponding to some embodiments. Player data is received (402) by the game server 130 from a player terminal 100. The betting platform 140 receives (404) data corresponding to the skill-based challenge from the game server 130. Side wager data is sent (406) to a bettor terminal 100' from the betting platform 140. The betting platform receives (408) a side wager from a bettor via the bettor terminal 100'.

Side wager data is sent (410) to the player via a player terminal 100 from the game server 130 or the betting platform 140. During the skill-based challenge, player performance data is received (412) by the betting platform 140 from the game server 130. Based on the player performance data, updated side wager data is sent (414) to the bettor terminal 100' by the betting platform 140. A wager is received (416) by the betting platform 140 from the bettor via the bettor terminal 100'. Based on the outcome of the skill-based challenge, a bettor monetary prize is awarded (418) to the bettor. Based on the side wagering activity, a player monetary prize is awarded to the player as a kick back of the side wagers (420). Player and/or bettor data is sent from the game server 130 (422) and the betting platform 140 (424) to a database 152 for storage and analysis.

Figure 5:
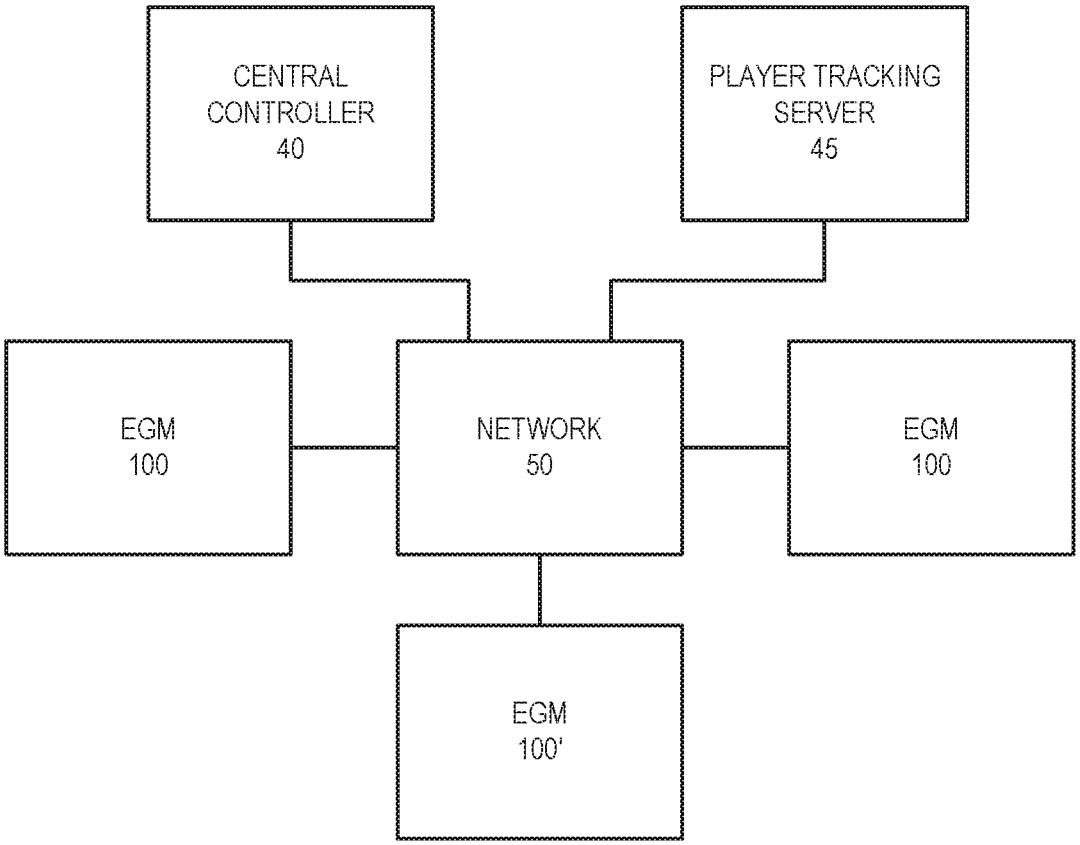
FIG. 5 is a block diagram illustrating an EGM network according to some embodiments.

Referring to FIG. 5, one or more EGMs 100 may be in communication with each other and/or at least one central controller 40 through a data network or remote communication link 50. The data network 50 may be a private data communication network that is operated, for example, by the gaming facility that operates the EGM 100. Communications over the data network 50 may be encrypted for security. The central controller 40 may be any suitable server or computing device which includes at least one processor and at least one memory or storage device. In different such embodiments, the central controller 40 is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central controller 40 is designed to transmit and receive events, messages, commands or any other suitable data or signal between the central controller 40 and each of the individual EGMs 100, 100'. The central controller 40 is operable to execute such communicated events, messages or commands in conjunction with the operation of the central server. It should be appreciated that one, more or each of the functions of the central controller 40 as disclosed herein may be performed by one or more EGM processors. It should be further appreciated that one, more or each of the functions of one or more EGM processors as disclosed herein may be performed by the central controller 40.

A player tracking server 45 may also be connected through the data network 50. The player tracking server 45 may manage a player tracking account that tracks the player's gameplay and spending, manages loyalty awards for the player, manages funds deposited or advanced on behalf of the player, and other functions. In some embodiments of the inventive concepts, the player tracking server 45 also keeps track of side wagers and player prizes that correspond to the side wagers.

Figure 6:
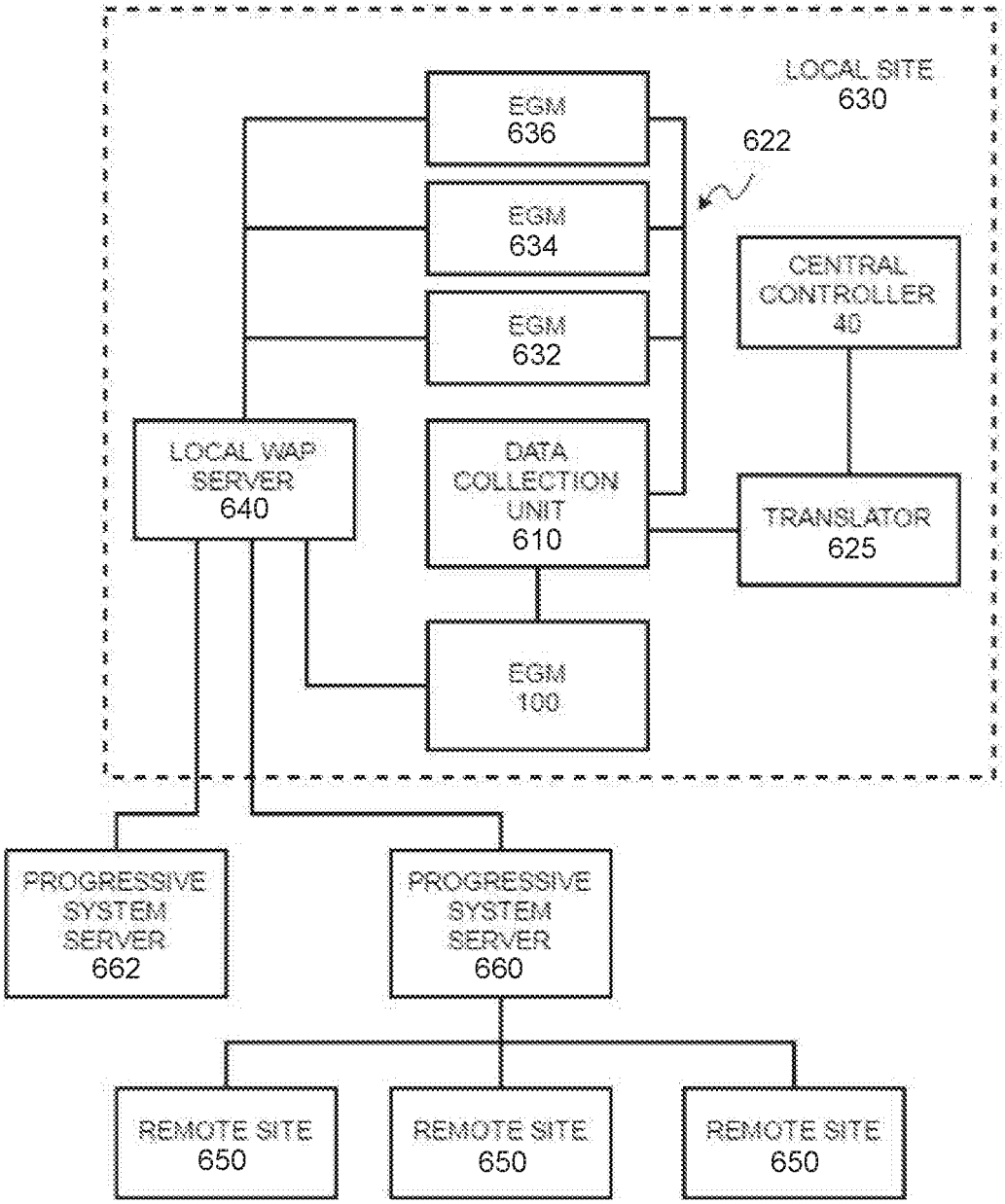
FIG. 6 is a block diagram illustrating an EGM that participates in one or more wide-area progressive (WAP) jackpot games along with a plurality of other EGMs according to some embodiments.

FIG. 6 illustrates an EGM 100 that participates in one or more wide-area progressive (WAP) jackpot games along with a plurality of other EGMs that may be located in different locations and that may offer the same game to players as the EGM 100. The participating EGMs may be connected in a progressive game network. The progressive game services enabled by the progressive game network increase the game playing capabilities of a particular gaming machine by enabling a larger jackpot than would be possible if the gaming machine was operating in a "stand alone" mode. Playing a game on a participating gaming machine gives a player a chance to win the progressive jackpot. The rate at which the jackpot grows increases as the number of gaming machines connected in the progressive network is increased. The size of the jackpot tends to increase game play on gaming machines offering a progressive jackpot. These types of games are referred to as "progressive games." A jackpot that must hit by a certain threshold is referred to as a "must hit by progressive game."

In a progressive jackpot game according to some embodiments, a portion of each wager on a game of chance played on the EGM 100 is contributed to a wide area progressive jackpot. The EGM 100 may be configured to participate in multiple different wide area progressive jackpot games. For example, as discussed above, an EGM 100 offering a hybrid skill/chance wagering game according to some embodiments may provide a player with the ability to participate in different WAP games depending on the level that the player has completed in the skill-based portion of the game.

An amount of a first wide area progressive jackpot and an amount of a second wide area progressive jackpot game that an EGM 100 participates in may differ from one another. Further, the probability of winning the first wide area progressive jackpot or the second wide area progressive jackpot may be different.

Each WAP jackpot game may be administered by a WAP system server that communicates over a data communication network with participating EGMs to provide progressive system services to the EGMs.

Referring to FIG. 6, a wide area progressive gaming system is illustrated in which a plurality of EGMs at geographically separated locations can participate in a wide area progressive jackpot game. The EGM 100 is located at a local site 630 along with other EGMs 632, 634, 636 that may participate in the WAP game. The local site 630 may correspond, for example, to a single gaming establishment at which each of the EGMs 100, 632-636 is operated. Each of the EGMs 100, 632-636 is managed by a central controller 40 (FIG. 5) at the local site 630. Each of the EGMs 100, 632-636 may be connected to the central controller 40 through a data collection unit (DCU) 210 and a translator 625. In some embodiments, the EGMs 100, 632-636 may be connected to the DCU 610 through a dedicated gaming network 622. In general, the DCU 610 functions as an intermediary between the different gaming machines on the network 622 and the central controller 40. In general, the DCU 610 receives data transmitted from the gaming machines and sends the data to the central controller 40. In some instances, when the hardware interface used by the gaming machine is not compatible with the central controller 40, a translator 625 may be used to convert serial data from the DCU 610 to a format accepted by the central controller 40. A plurality of DCUs 610 may be provided at the local site 630, and the translator 625 may provide this conversion service to multiple ones of the plurality of DCUs 610.

Further, in some dedicated gaming networks, the DCU 610 can receive data transmitted from the central controller 40 for communication to the EGMs 100, 632-636 on the gaming network 622. The received data may be communicated synchronously to the EGMs 100, 632-636 on the gaming network 622. Within a gaming establishment, the EGMs 100, 632-636 may be located on the gaming floor for player access while the central controller 40 is usually located in another part of gaming establishment (e.g. the backroom), or at another location.

Each of the EGMs 100, 632-636 shown in FIG. 6 is also connected to at least one local WAP server 640, which coordinates communication with one or more progressive system servers 660, 662 that are typically located at a remote location or locations. The local WAP server 640 manages communication of the EGMs 100, 632-636 with the progressive system servers 660, 662, monitors coin-in and payouts of the EGMs 100, 632-636 and sends a portion of received funds to the progressive system servers 660, 662 for inclusion in their respective progressive jackpots.

The local WAP server 640 may be used to route messages indicating contributions and eligibility status to different progressive servers. The local WAP server 640 may also be used in a polling scheme to route messages between different EGMs 100, 632-636 and different progressive servers 660, 662.

Each of the progressive system servers 660, 662 administers at least one WAP game. Moreover, each of the progressive system servers 660, 662 may communicate with local WAP servers 640 at a plurality of geographically distributed locations, as illustrated in FIG. 6.

In some embodiments, an amount of a first wide area progressive jackpot may be maintained by progressive system server 660 and an amount of the second wide area progressive jackpot may be maintained by progressive system server 662. In some embodiments, a single progressive system server may maintain multiple wide area progressive jackpots. Thus, in another embodiment, the progressive system server 660 (or the progressive system server 662) may maintain both the first wide area progressive jackpot and the second wide area progressive jackpot.

The EGM 100 may be designed to display progressive jackpot amounts for each of the progressive games available for display on the EGM 100. For example, the EGM 100 may receive updates of a first progressive jackpot amount from the progressive system server 660 and a second progressive jackpot amount from the progressive system server 662. The progressive jackpot amounts may be displayed serially or concurrently with information describing the progressive game with which it is associated. The progressive jackpot amounts may be displayed on a display on or nearby the EGM 100.

In general, the functions of different devices shown in FIG. 6 may be combined or separated as is warranted by a particular gaming environment. For example, the central controller 40 may provide functions of one or more of a local WAP server 640, a DCU 610, and/or a translator 625.

In general, the dedicated communication network 622 over which the EGMs 100, 632-636 communicate may not be accessible to the public. Due to the sensitive nature of much of the information on the dedicated networks, for example, electronic fund transfers and player tracking data, usually the manufacturer of a host system, such as a player tracking system, or group of host systems, employs a particular networking language having proprietary protocols. These proprietary protocols are usually considered highly confidential and not released publicly. Thus, whenever a new host system is introduced for use with a gaming machine, rather than trying to interpret all the different protocols utilized by different manufacturers, the new host system is typically designed as a separate network. Consequently, as more host systems are introduced, the independent network structures continue to build up in the casino.

Further, in the gaming industry, many different manufacturers make gaming machines. The communication protocols on the gaming machine are typically hard-coded into the gaming machine software, and each gaming machine manufacturer may utilize a different proprietary communication protocol. A gaming machine manufacturer may also produce host systems, in which case their gaming machines are compatible with their own host systems. However, in a heterogeneous gaming environment, such as a casino, gaming machines from many different manufacturers, each with their own communication protocol, may be connected to host systems from many different manufacturers, each with their own communication protocol. Therefore, communication compatibility issues regarding the protocols used by the gaming machines in the system and protocols used by the host systems must be considered.

Communications between the local WAP server 640 and the progressive system servers 660, 662 may occur over public and/or private networks, and may include circuit switched and/or packet switched networks or sub-networks. Accordingly, communication sessions between the local WAP server 640 and a progressive system server 662, 664 may be authenticated, and the communications themselves may be encrypted for security.

Player Tracking

In various embodiments, the gaming system includes one or more player tracking systems under control of the player tracking module 20B shown in FIG. 2C. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In some embodiments, the player tracking system does so through the use of player tracking cards. In some embodiments, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In some embodiments, the gaming system utilizes any suitable biometric technology or ticket technology to track when a gaming session begins and ends.

In some embodiments, during one or more gaming sessions, the gaming system tracks any suitable information or data, such as any amounts wagered, average wager amounts, side wagers, and/or the time at which these wagers are placed. In some embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

Other EGM Features

Embodiments described herein may be implemented in various configurations for EGMs 100*s*, including but not limited to: (1) a dedicated EGM, wherein the computerized instructions for controlling any games (which are provided by the EGM) are provided with the EGM prior to delivery to a gaming establishment; and (2) a changeable EGM, where the computerized instructions for controlling any games (which are provided by the EGM) are downloadable to the EGM through a data network when the EGM is in a gaming establishment. In some embodiments, the computerized instructions for controlling any games are executed by at least one central server, central controller or remote host. In such a "thin client" embodiment, the central server remotely controls any games (or other suitable interfaces) and the EGM is utilized to display such games (or suitable interfaces) and receive one or more inputs or commands from a player. In some embodiments, the computerized instructions for controlling any games are communicated from the central server, central controller or remote host to a EGM local processor and memory devices. In such a "thick client" embodiment, the EGM local processor executes the communicated computerized instructions to control any games (or other suitable interfaces) provided to a player.

In some embodiments, an EGM may be operated by a mobile device, such as a mobile telephone, tablet other mobile computing device.

In some embodiments, one or more EGMs in a gaming system may be thin client EGMs and one or more EGMs in the gaming system may be thick client EGMs. In some embodiments, certain functions of the EGM are implemented in a thin client environment and certain other functions of the EGM are implemented in a thick client environment. In some embodiments, computerized instructions for controlling any primary games are communicated from the central server to the EGM in a thick client configuration and computerized instructions for controlling any secondary games or bonus functions are executed by a central server in a thin client configuration.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal EGMs, such as desktop computers, laptop computers, tablet computers or computing devices, personal digital assistants (PDAs), mobile telephones such as smart phones, and other mobile computing devices.

In some embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In some embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In some embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

Examples of implementations of Internet-based gaming are further described in U.S. Pat. No. 8,764,566, entitled "Internet Remote Game Server," and U.S. Pat. No. 8,147,334, entitled "Universal Game Server," which are incorporated herein by reference.

Further Definitions and Embodiments

In the above-description of various embodiments, various aspects may be illustrated and described herein in any of a number of patentable classes or contexts including any new and useful process, machine, manufacture, or composition of matter, or any new and useful improvement thereof. Accordingly, various embodiments described herein may be implemented entirely by hardware, entirely by software (including firmware, resident software, micro-code, etc.) or by combining software and hardware implementation that may all generally be referred to herein as a "circuit," "module," "component," or "system." Furthermore, various embodiments described herein may take the form of a computer program product comprising one or more computer readable media having computer readable program code embodied thereon.

Any combination of one or more computer readable media may be used. The computer readable media may be a computer readable signal medium or a non-transitory computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible non-transitory medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Various embodiments were described herein with reference to flowchart illustrations and/or block diagrams of methods, apparatus (systems), devices and computer program products according to various embodiments described herein. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a non-transitory computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods, and computer program products according to various aspects of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be designated as "/". Like reference numbers signify like elements throughout the description of the figures.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and sub-combinations of the embodiments described herein, and of the manner and process of making and using them, and shall support claims to any such combination or sub-combination.

In the drawings and specification, there have been disclosed typical embodiments and, although specific terms are employed, they are used in a generic and descriptive sense only and not for purposes of limitation, the scope of the inventive concepts being set forth in the following claims.

What is claimed is:

1. A gaming system comprising:
a processor;
a display device;
an input device; and
a memory device storing a plurality of instructions which, when executed by the processor, cause the processor to operate with the display device and the input device, for a play of a wagering game, to:
receive, from a bettor, a wager that corresponds to a selected player of a plurality of players in a skill-based challenge;
determine that the selected player has achieved a threshold outcome in the skill-based challenge;
award a bettor monetary prize to the bettor in response to the selected player achieving the threshold outcome in the skill-based game; and
award a player monetary prize to the selected player, wherein the amount of the player monetary prize is based on the wager that is received from the bettor and based on the threshold outcome,
wherein the bettor is not a participant in the skill-based challenge.

2. The gaming system of claim 1, wherein the skill-based challenge comprises a player versus player challenge that includes the selected player competing against another one of the plurality of players, wherein a performance of the selected player is determined relative to performances of other ones of the plurality of players, and wherein the threshold outcome is related to the performance of the selected player.

3. The gaming system of claim 1, wherein the skill-based challenge comprises a player versus house challenge, wherein a performance of the selected player is independent of other ones of the plurality of players, and wherein the threshold outcome is related to the performance of the selected player.

4. The gaming system of claim 1, wherein the skill-based challenge comprises a hybrid player versus house and player versus player challenge, and wherein the threshold outcome is related to the performance of the selected player.

5. The gaming system of claim 1, wherein the plurality of players comprises a plurality of teams of players, and wherein the selected player is on one of the plurality of teams of players.

6. The gaming system of claim 5, wherein the selected player is on a selected team of the plurality of teams,
wherein the wager corresponds to the selected team in the skill-based challenge, and
wherein the threshold outcome in the skill-based challenge is a team threshold outcome.

7. The gaming system of claim 5, wherein the wager corresponds to the selected player on the one team, and
wherein the threshold outcome in the skill-based challenge is based on an individual performance of the selected player on the one team.

8. The gaming system of claim 1, wherein the wager is a fixed odds based wager, wherein the instructions, when executed by the processor, cause the processor to determine an odds value before the skill-based challenge begins based on a skill evaluation corresponding to the selected player.

9. The gaming system of claim 8, wherein the instructions, when executed by the processor, cause the processor to determine an updated odds value during the skill-based challenge,
wherein the wager that corresponds to the selected player may be received during the skill-based challenge using the updated odds value.

10. The gaming system of claim 1, wherein the wager is a pari-mutuel odds based wager, wherein the instructions, when executed by the processor, cause the processor to determine an odds value based on wager activity of other bettors.

11. The gaming system of claim 1, wherein the instructions, when executed by the processor, cause the processor to display wager performance corresponding to each of the plurality of players.

12. The gaming system of claim 1, wherein the instructions, when executed by the processor, cause the processor to display player monetary prize data corresponding to each of the plurality of players.

13. A gaming system comprising:
a processor;
a display device;
an input device; and
a memory device storing a plurality of instructions which, when executed by the processor, cause the processor to operate with the display device and the input device, for a play of a wagering game, to:
receive, from a plurality of bettors, a respective plurality of wagers that correspond to selected players of a plurality of players in a multiplayer skill-based challenge;
determine that ones of the selected players have achieved a threshold outcome in the skill-based challenge;
award a bettor monetary prize to ones of the plurality of bettors in response to the corresponding selected players that achieve the threshold outcomes in the multiplayer skill-based game; and
award each of the ones of the selected players that achieved the threshold outcome a player monetary prize based on an amount of the wagers that are received from the plurality of bettors and based on the threshold outcomes.

14. The gaming system of claim 13, wherein the plurality of players comprises a plurality of teams of players,
wherein the selected players are on ones of the plurality of teams of players.

15. The gaming system of claim 14, wherein the selected player is on a selected team of the plurality of teams,
wherein the wager corresponds to the selected team in the skill-based challenge, and
wherein the threshold outcome in the skill-based challenge is a team threshold outcome.

16. The gaming system of claim 14,
wherein the wager corresponds to the selected player on the one team, and
wherein the threshold outcome in the skill-based challenge is based on an individual performance of the selected player on the one team.

17. The gaming system of claim 13, wherein the plurality of wagers are a fixed odds based wagers, wherein the instructions, when executed by the processor, cause the processor to determine odds values before the skill-based challenge begins based on a skill evaluation corresponding to ones of the selected players.

18. The gaming system of claim 13, wherein the wagers are pari-mutuel odds based wagers,
wherein the instructions, when executed by the processor, cause the processor to determine odds values based on wager activity of other ones of the plurality of bettors.

19. The gaming system of claim 13, wherein the instructions, when executed by the processor, cause the processor to display wager performance corresponding to each of the plurality of players and each of the plurality of bettors.

20. A method comprising:

receiving, from a bettor, a wager that corresponds to a selected player of a plurality of players in a skill-based challenge;

determining that the selected player has achieved a threshold outcome in the skill-based challenge;

awarding a bettor monetary prize to the bettor in response to the selected player achieving the threshold outcome in the skill-based game; and awarding a player monetary prize to the selected player, wherein the player monetary prize is based on an amount of the wager that is received from the bettor and based on the threshold outcome.

* * * * *